US005369077A

United States Patent [19]

Harrison et al.

[11] Patent Number: 5,369,077

[45] Date of Patent: Nov. 29, 1994

[54] THERMAL DYE TRANSFER RECEIVING ELEMENT

[75] Inventors: Daniel J. Harrison, Pittsford; Paul D. Yacobucci, Rochester, both of N.Y.

[73] Assignee: Eastman Kodak Company, Rochester, N.Y.

[21] Appl. No.: 799,919

[22] Filed: Nov. 26, 1991

Related U.S. Application Data

[63] Continuation of Ser. No. 665,613, Mar. 6, 1991, abandoned.

[51] Int. Cl.[5] ..... B41M 5/035; B41M 5/38

[52] U.S. Cl. ..... 503/227; 428/195; 428/412; 428/423.1; 428/447; 428/480; 428/913; 428/914

[58] Field of Search ..... 8/471; 428/195, 412, 428/423.1, 447, 480, 913, 914; 503/227

[56] References Cited

U.S. PATENT DOCUMENTS

| | | | |
|---|---|---|---|
| 4,626,256 | 12/1986 | Kawasaki et al. | 8/471 |
| 4,775,657 | 10/1988 | Harrison et al. | 503/227 |
| 4,839,338 | 6/1989 | Marbrow | 503/227 |
| 4,927,803 | 5/1990 | Bailey et al. | 503/227 |
| 4,942,212 | 7/1990 | Hanada et al. | 528/28 |
| 4,990,485 | 2/1991 | Egashira et al. | 503/227 |
| 4,992,413 | 2/1991 | Egashira et al. | 503/227 |

FOREIGN PATENT DOCUMENTS

| | | | |
|---|---|---|---|
| 61-199997 | 9/1986 | Japan | 503/227 |
| 63-134239 | 6/1988 | Japan | 503/227 |
| 2-295789 | 12/1990 | Japan | 503/227 |

*Primary Examiner*—B. Hamilton Hess
*Attorney, Agent, or Firm*—Harold E. Cole

[57] ABSTRACT

A dye-receiving element for thermal dye transfer includes a support having on one side thereof a dye image-receiving layer. Receiving elements of the invention are characterized in that the dye image-receiving layer or an overcoat layer thereon comprises a linear condensation copolymer containing block polysiloxane units copolymerized into a linear polymer chain.

19 Claims, No Drawings

THERMAL DYE TRANSFER RECEIVING ELEMENT

This is a continuation of application Ser. No. 07/665,613, filed Mar. 6, 1991, now abandoned.

This invention relates to dye-receiving elements used in thermal dye transfer, and more particularly to polymeric dye image-receiving or overcoat layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen for its compatibility and receptivity for the dyes to be transferred from the dye donor element.

When the dye donor and receiving elements are brought into contact and the donor element is image-wise heated in order to transfer a dye image to the receiving element, there is a problem in that the dye layer of the donor element and the dye-receiving layer of the receiver element tend to fuse or stick together due to the intense local heating required to transfer the dye. This problem is especially evident at higher density regions of the transferred image, as the higher density requires higher heating in order to transfer a greater amount of dye. Such sticking or fusing may result in donor dye layer transfer to the receiver or in the worst case tearing of the dye donor element, which results in unacceptable image prints.

In an effort to overcome the problems associated with sticking between the donor and receiver elements, the prior art has made use of release agents. EP-A-0133012, for example, discloses a receiver element comprising a support having an image-receiving layer thereon, wherein a dye-permeable release agent such as silicone oil is present either in the image-receiving layer or in a separate release layer on at least part of the image receiving layer. Free silicones can be depleted from the receiver by diffusion into the dye donor during dye transfer, however, and when multiple printings are made on a single receiving element as is required in order to obtain a full color image, dye layer to receiving layer sticking may still occur.

Linear polymers have been used as dye-receiving polymers, and such polymers having excellent image stability and dye uptake are disclosed in U.S. Pat. No. 4,927,803. Linear polymers such as these, however, may still suffer from dye donor to receiver sticking problems.

Polymers having a Tg lower than that of the main receiver layer have been used for receiver overcoat layers which improve transferred dye image stability, and such overcoats are disclosed in U.S. Pat. No. 4,775,657. Even dual layer receivers such as these, however, may also still suffer from dye donor to receiver sticking problems.

Attempts to increase the compatibility of silicone release agents to receiver polymers and decrease silicone depletion upon multiple printing have included grafting or cross-linking polysiloxane units to the backbone of a preformed receiver polymer. Japanese Kokai 61/199997-A (Dai Nippon) discloses receiving layers comprising a thermoplastic polyester resin, an isocyanate having at least two isocyanate groups, and modified silicone oil having a functional group which reacts with an isocyanate group. EP-A-368320 (Dai Nippon) discloses receiving layers comprising graft copolymers comprising releasing segments (e.g. polysiloxane segments) graft bonded to the main chain of a receiver polymer backbone. Japanese Kokai 63/134239-A (Mitsubishi Chem.) discloses a receiver comprising a thermoplastic resin and a silicone compound prepared by reacting an amino-modified silicone compound with carboxylic or sulfonic acid or their derivatives, wherein the silicone compound is blended into the receiver layer resin or coated on top thereof.

While cross-linking silicone into a receiver polymer network reduces silicone depletion upon multiple printing, the formulations required are difficult to manufacture due to short coating solution lifetimes and the requirement of additional post coating curing steps to achieve sufficient cross-linking. Additionally, while the use of release media is desired to prevent donor to receiver sticking, substantially cross-linked media may act as an undesirable barrier to dye diffusion into the receiving layer. Grafted polymers also require that the main polymer backbone contain active grafting sites, and an additional grafting reaction after formation of the main polymer.

Accordingly, it would be highly desirable to provide an easily manufacturable receiver element for thermal dye transfer processes having excellent dye uptake and image stability and which would not stick to dye donor elements.

These and other objects are achieved in accordance with this invention which comprises a dye-receiving element for thermal dye transfer comprising a support having on one side thereof a dye image-receiving layer, wherein the dye image-receiving layer or an overcoat layer thereon comprises a linear condensation copolymer containing block polysiloxane units copolymerized into the main polymer chain.

In accordance with this invention, it has been found that copolymerizing polysiloxane block units into linear receiver polymers results in linear receiver polymers which maintain excellent image stability and dye uptake properties while the polymers themselves become much more resistant to dye donor sticking. These properties make such linear copolymers ideally suited for use in a receiver overcoat, or alternatively for use as a sole dye image-receiving layer polymer or blended with other receiver polymers in a single image-receiving layer. The copolymers are readily manufacturable, and do not require any post coating curing steps to bond siloxanes to a main polymer chain. Further, the receiver polymer units need not have additional functional groups for grafting of the siloxanes after formation of the receiver main polymer chain.

To obtain linear receiver copolymers of the invention, monomer units which form, for example, polycarbonates, polyurethanes, or polyesters upon condensation may be copolymerized with functional group terminated polysiloxanes of the general formula (I):

(I)

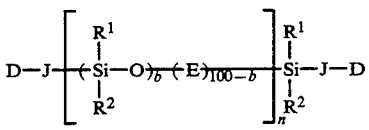

wherein:

$R^1$ and $R^2$ are each independently substituted or unsubstituted alkyl of from about 1 to 6 carbon atoms (preferably a methyl group or a fluoro substituted alkyl group), or substituted or unsubstituted phenyl, with the proviso that $R^1$ and $R^2$ are not both phenyl;

J is a bivalent linking group (preferably $-(CH_2)_p-$ where p is 1 to 10);

D is amino, hydroxyl, or thiol;

E represents optional second siloxane units which may be diphenyl substituted, or oxyalkylene containing units;

b represents 50 to 100 mole percent; and n is chosen such as to provide a molecular weight of from about 1,000 to 30,000 (preferably 1,000 to 15,000) for the polysiloxane block unit.

Preferred linear copolymers of the invention are of the following general structure (II):

(II)

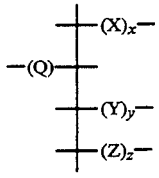

wherein:

Q represents linkage units which together with units X, Y and Z form ester type linkage units (including, for example, carbonate and thiocarbonate) or amide type linkage units (including, for example, urethane, urea, and thiocarbamate);

X is derived from one or more non-phenolic diol units, present at x=0 to 99.9 mole %;

Y is derived from an aromatic diphenolic unit, present at y=0 to 99.9 mole %;

Z is derived from a functional group terminated polysiloxane as described above present at z=0.1 to 10.0 mole %, preferably 0.2 to 4.0 mole %; and $x+y+z=100$.

Ester units may be formed by condensing an aliphatic or aromatic dibasic acid (such as Q5 through Q8 illustrated below) with diol (such as X1 through X10 illustrated below) or diphenolic (such as bisphenols Y1 through Y7 illustrated below) units to form a polyester. Amide units may similarly be formed by condensing a diisocyanate (such as Q2 through Q4 illustrated below) with diol or diphenolic units to form a polyurethane. Carbonate units may be formed by condensing a chloroformate or phosgene with diol or diphenolic units to form a polycarbonate. The term "polycarbonate" as used herein means a polyester of carbonic acid and a diol or diphenol.

When Q is carbonate, X and Y are preferred at a molar ratio of from about 3:1 to about 1:3. When Q is a urethane, X is preferred at 90 to 99.9 mole %. When Q is an ester derived from a dibasic aliphatic acid, Y is preferred at at least 75 mole %. When Q is an ester derived from an aromatic dibasic acid, X is preferred at at least 75 mole %.

Carbonates are represented within Q as being derived from Q1, carbonic acid:

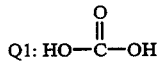

Q1: $HO-\overset{O}{\overset{\|}{C}}-OH$

Amides are represented within Q as being derived from, for example, diisocyanates Q2, Q3, or Q4:

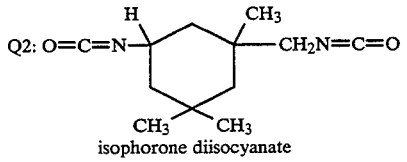

Q2: $O=C=N-$ ... $-CH_2N=C=O$ isophorone diisocyanate

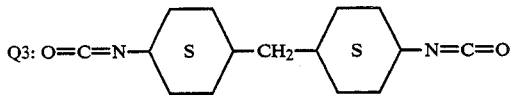

Q3: $O=C=N-$ S $-CH_2-$ S $-N=C=O$ 4,4'-methylenebis(cyclohexylisocyanate)

Q4: $O=C=N-(CH_2)_6-N=C=O$ hexamethylene diisocyanate

Esters are represented within Q as being derived from, for example, aliphatic or aromatic dibasic acids Q5 through Q8:

Q5: $HO_2C(CH_2)_7CO_2H$ azelaic acid

Q6: $HO_2C(CH_2)_4CO_2H$ adipic acid

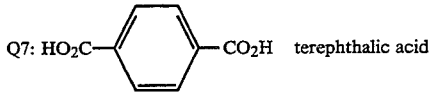

Q7: $HO_2C-$ ... $-CO_2H$ terephthalic acid

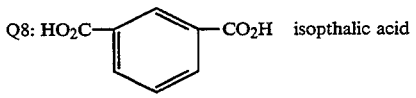

Q8: $HO_2C-$ ... $-CO_2H$ isopthalic acid

Specific examples of aliphatic or aromatic non-phenolic glycols that may be copolymerized include X1 through X10:

X1: $HOCH_2CH_2OH$ ethylene glycol
X2: $HO(CH_2)_3OH$ 1,3-propanediol
X3: $HO(CH_2)_4OH$ 1,4-butanediol
X4: $HO(CH_2)_5OH$ 1,5-pentanediol
X5: $HO(CH_2)_9OH$ 1,9-nonanediol
X6: $O(CH_2CH_2OH)_2$ diethylene glycol
X7: $HOCH_2C(CH_3)_2CH_2OH$ neopentyl glycol
X8: $HO(CH_2CH_2O)_{20-70}H$ polyethylene glycol
X9: $H\text{-}[O(CH_2)_5-CO]_{50-100}OH$
hydroxyterminated polycaprolactone

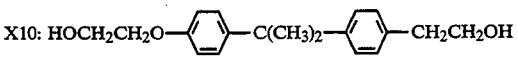

4,4'-bis(hydroxyethyl)bisphenol-A

Specific examples of aromatic bisphenols that may be copolymerized include Y1 through Y7:

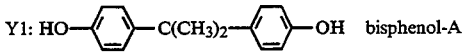

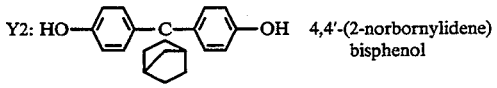

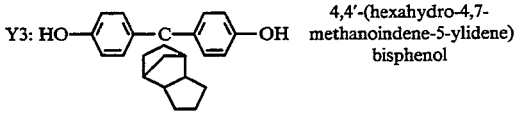

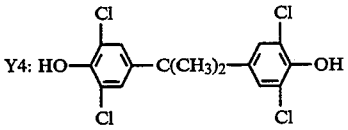

tetrachlorobisphenol-A

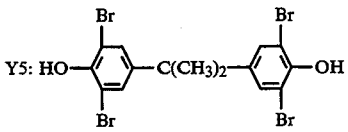

tetrabromobisphenol-A

-continued

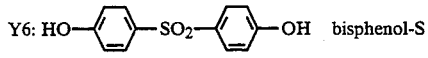

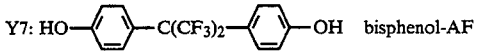

Specific examples of siloxanes that may be copolymerized include Z1 through Z8:

Z1: $H_2N(CH_2)_3\text{-}[Si(CH_3)_2O]_n Si(CH_3)_2(CH_2)_3NH_2$

Z2: $HO(CH_2)_2\text{-}[Si(CH_3)_2O]_n Si(CH_3)_2(CH_2)_2OH$

Z3: $HS(CH_2)_{10}\text{-}[Si(CH_3)_2O]_n Si(CH_3)_2(CH_2)_{10}SH$

Z4: $H_2N(CH_2)_4\text{-}[Si(CH_3)(C_6H_5)O]_n Si(CH_3)(CH_6H_5)(CH_2)_4NH_2$

Z5: $H_2N(CH_2)_3\text{-}[Si(CH_3)(CH_2CF_3)O]_n Si(CH_3)_2(CH_2)_3NH_2$

Z6: $H_2N(CH_2)_3\text{-}[[Si(CH_3)_2O]_b[Si(C_6H_5)_2O]_{100-b}]_n Si(CH_3)_2(CH_2)_3NH_2$ Z7: $H_2N(CH_2)_6\text{-}[[Si(CH_3)_2O]_b[CH_2CH_2O]_{100-b}]_n Si(CH_3)_2(CH_2)_6NH_2$ Z8: $HOCH_2\text{-}\left[[Si(CH_3)_2O]_b\left(Si(CH_3)O\text{-}\underset{\underset{(Si(CH_3)_2O)_m Si(CH3)_3}{|}}{O}\right)_{100-b}\right]_n CH_2OH$ Wherein m and n are each 20 to 200, and b is 50 to 100 mole %. Specific values for m, n, and b are set forth in the polymer listings below.

These siloxane block units should represent 0.1 to 10.0 mole %, preferably 0.2 to 4.0 mole %, of the final polymer. The mole percentage of the siloxane block unit in the final polymer should be selected based upon the molecular weight of the siloxane block in order to generate a copolymer comprising from about 1 to about 40 wt % of siloxane block units, preferably from about 3 to about 30 wt %. Above about 40 wt % siloxane, problems occur with incorporation of the siloxane blocks into the linear polymer chain, while below 1 wt % siloxane, release between the dye donor and receiver is not as facilitated as desired.

Preferred polymers of the invention are polycarbonates E-1 through E-9 below, represented by the following structure (III):

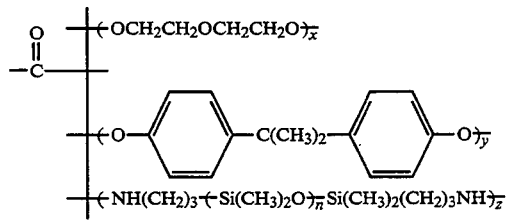

| Polymer | CARBONATE Mole % Q | ALIPHATIC DIOL Mole % X | BISPHENOL Mole % Y | SILICONE Mole % Z | n |
|---|---|---|---|---|---|
| E-1 | 100% Q1 | 49.5% X6 | 49.5% Y1 | 1.0% Z1 | 21 |
| E-2 | 100% Q1 | 49.8% X6 | 49.8% Y1 | 0.4% Z1 | 21 |
| E-3 | 100% Q1 | 49.9% X6 | 49.9% Y1 | 0.2% Z1 | 50 |
| E-4 | 100% Q1 | 49.7% X6 | 49.8% Y1 | 0.5% Z1 | 50 |
| E-5 | 100% Q1 | 49.7% X6 | 49.8% Y1 | 0.5% Z1 | 187 |
| E-6 | 100% Q1 | 49.5% X6 | 49.5% Y1 | 1.0% Z1 | 187 |
| E-7 | 100% Q1 | 49.0% X6 | 49.0% Y1 | 2.0% Z1 | 187 |
| E-8 | 100% Q1 | 48.5% X6 | 48.5% Y1 | 3.0% Z1 | 187 |
| E-9 | 100% Q1 | 48.0% X6 | 48.0% Y1 | 4.0% Z1 | 187 |

| Polymer | CARBONATE Mole % Q | ALIPHATIC DIOL Mole % X | BISPHENOL Mole % Y | SILICONE Mole % Z | n |
|---|---|---|---|---|---|
| E-10 | 100% Q1 | 25.0% X1 | 65.0% Y1 | 10.0% Z1 | 187 |
| E-11 | 100% Q1 | 90.9% X1 | 7.5% Y2 | 2.5% Z1 | 187 |
| E-12 | 100% Q1 | 50.0% X1 | 47.5% Y3 | 2.5% Z1 | 50 |
| E-13 | 100% Q1 | 35.0% X1 | 60.0% Y4 | 5.0% Z1 | 50 |
| E-14 | 100% Q1 | 75.0% X1 | 24.2% Y5 | 0.8% Z7* | 50 |
| E-15 | 100% Q1 | 50.0% X1 | 48.5% Y6 | 1.5% Z8** | 50 |
| E-16 | 100% Q1 | 20.0% X2 | 79.2% Y1 | 0.8% Z5 | 50 |
| E-17 | 100% Q1 | 75.0% X3 | 24.2% Y7 | 0.8% Z8** | 50 |
| E-18 | 100% Q1 | 48.0% X3 | 50.0% Y1 | 2.0% Z1 | 21 |
| E-19 | 100% Q1 | 48.0% X3 | 50.0% Y1 | 2.0% Z1 | 50 |
| E-20 | 100% Q1 | 20.0% X4 | 77.5% Y1 | 2.5% Z1 | 187 |
| E-21 | 100% Q1 | 80.0% X4 | 19.7% Y2 | 0.3% Z5 | 21 |
| E-22 | 100% Q1 | 30.0% X4 | 69.9% Y2 | 0.1% Z6*** | 50 |
| E-23 | 100% Q1 | 70.0% X5 | 29.2% Y1 | 0.8% Z1 | 187 |
| E-24 | 100% Q1 | 50.0% X5 | 45.0% Y6 | 5.0% Z2 | 50 |
| E-25 | 100% Q1 | 70.0% X5 | 29.7% Y7 | 0.3% Z3 | 50 |
| E-26 | 100% Q1 | 30.0% X7 | 69.7% Y2 | 0.3% Z1 | 187 |
| E-27 | 100% Q1 | 97.5% X7 | — | 2.5% Z1 | 50 |
| E-28 | 100% Q1 | 59.7% X5<br>40.0% X7 | — | 0.3% Z1 | 187 |
| E-29 | 100% Q1 | 59.7% X10 | 40.0% Y3 | 0.3% Z6*** | 187 |

*b = 99 mole %
**b = 90 mole %, m = 50
***b = 95 mole %

| Polymer | ISOCYANATE Mole % Q | ALIPHATIC DIOL Mole % X | BISPHENOL Mole % Y | SILICONE Mole % Z | n |
|---|---|---|---|---|---|
| E-30 | 100% Q2 | 50.0% X5 | 49.2% Y1 | 0.8% Z1 | 50 |
| E-31 | 100% Q2 | 98.0% X5 | — | 2.0% Z1 | 21 |
| E-32 | 100% Q2 | 98.0% X6 | — | 2.0% Z1 | 21 |
| E-33 | 100% Q2 | 29.7% X2<br>70.0% X3 | — | 0.3% Z1 | 21 |
| E-34 | 100% Q2 | 40.0% X4<br>57.5% X8 | — | 2.5% Z1 | 50 |
| E-35 | 100% Q2 | 20.0% X5<br>75.0% X6 | — | 5.0% Z1 | 50 |
| E-36 | 100% Q3 | 99.7% X2 | — | 0.3% Z2 | 187 |
| E-37 | 100% Q3 | 99.7% X9 | — | 0.3% Z8* | 50 |
| E-38 | 100% Q4 | 79.2% X2 | 20.0% Y1 | 0.8% Z1 | 21 |
| E-39 | 100% Q4 | 92.0% X5 | — | 8.0% Z1 | 50 |

*b = 80 mole %, m = 50

| Polymer | DIACID Mole % Q | ALIPHATIC DIOL Mole % X | BISPHENOL Mole % Y | SILICONE Mole % Z | n |
|---|---|---|---|---|---|
| E-40 | 100% Q5 | — | 99.7% Y1 | 0.3% Z1 | 50 |
| E-41 | 100% Q5 | — | 98.0% Y1 | 2.0% Z1 | 50 |
| E-42 | 100% Q5 | 40.0% X1 | 57.5% Y1 | 2.5% Z1 | 21 |
| E-43 | 100% Q5 | 25.0% X6 | 72.5% Y1 | 2.5% Z1 | 187 |
| E-44 | 100% Q5 | 30.0% X7 | 65.0% Y2 | 5.0% Z2 | 21 |
| E-45 | 100% Q6 | 10.0% X4 | 89.2% Y6 | 0.8% Z5 | 50 |
| E-46 | 100% Q7 | 75.0% X6 | 24.7% Y7 | 0.3% Z1 | 50 |
| E-47 | 100% Q7 | 99.2% X2 | — | 0.8% Z6* | 50 |
| E-48 | 100% Q8 | 89.2% X4 | 10.0% Y6 | 0.8% Z1 | 50 |

-continued

| Polymer | DIACID Mole % Q | ALIPHATIC DIOL Mole % X | BISPHENOL Mole % Y | SILICONE Mole % Z | n |
|---|---|---|---|---|---|
| E-49 | 100% Q8 | 97.5% X10 | — | 2.5% Z3 | 21 |
| E-50 | 50% Q5<br>50% Q7 | 50.0% X4 | 47.5% Y6 | 2.5% Z1 | 50 |
| E-51 | 90% Q5<br>10% Q8 | 10.0% X5 | 89.7% Y7 | 0.3% Z5 | 50 |

*b = 99 mole %

The support for the dye-receiving element of the invention may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Ser. No. 07/485,676 of Harrison and U.S. Ser. No. 07/547,580 of Martin, the disclosures of which are incorporated by reference.

As set forth above, the invention polymers may be used in a receiving layer alone or in combination with other receiving layer polymers. In a preferred embodiment, the linear siloxane block copolymers of the invention are used in an overcoat layer over a main receiving layer. The use of overcoat layers is described in U.S. Pat. No. 4,775,657 of Harrison et al., the disclosure of which is incorporated by reference. Receiving layer polymers which may be overcoated with the polymers of the invention include polycarbonates, polyurethanes, polyesters, polyvinyl chlorides, poly(styrene-co-acrylonitrile), poly(caprolactone) or any other receiver polymer and mixtures thereof.

In a preferred embodiment, the polymers of the invention are used as an overcoat on a dye image-receiving layer which comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG MACROLON 5700®, and the polycarbonates disclosed in U.S. Pat. No. 4,927,803 of Bailey et al., the disclosure of which is incorporated by reference.

The dye image-receiving and overcoat layers may be present in any amount which is effective for their intended purposes. In general, good results have been obtained at a receiver layer concentration of from about 1 to about 10 g/m$^2$ and an overcoat layer concentration of from about 0.01 to about 3.0 g/m$^2$, preferably from about 0.1 to about 1 g/m$^2$.

A dye-donor element that is used with the dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3-R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

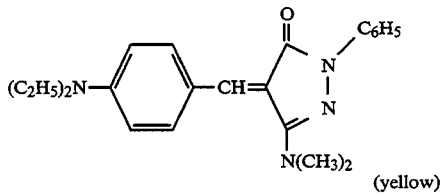

(yellow)

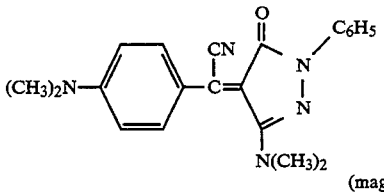

(magenta)

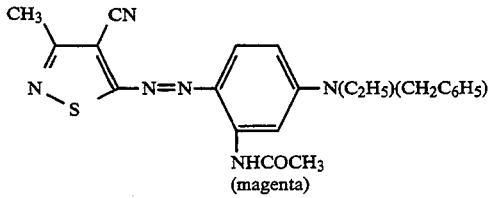

(magenta)

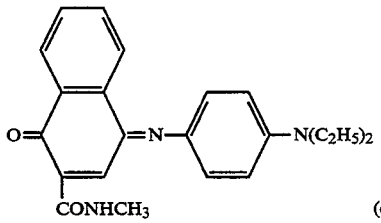

(cyan)

-continued

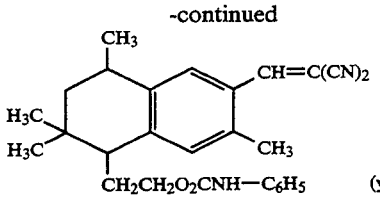

(yellow)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 um. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Examples of such lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly (vinyl alcohol-co-butyral ), poly (vinyl alcohol-co-acetal) , poly (styrene), poly (styrene-co-acrylonitrile), poly (vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 wt %, preferably 0.5 to 40 wt %, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention. The synthesis examples are representative, and other polymers of the invention may be prepared analogously or by other methods know in the art.

Preparation 1 (Polymer E-D)

A polycarbonate of diethylene glycol (49.7 mole %), bisphenol-A (49.8 mole %) and a bis (aminopropyl-terminated) polydimethyl siloxane (0.50 mole %).

To a 3-neck round bottom flask equipped with a stirrer, dropping funnel and condenser were added bisphenol-A bischloroformate (35.3 g, 0.10 mol), diethylene glycol (10.6 g, 0.10 mol), 14,000 molecular weight aminopropyl-terminated polydimethylsiloxane (4.3 g, 0.0003 mol) and dichloromethane (150 ml). The solution was cooled to 0°–5° C. and with vigorous stirring pyridine (25 ml) was added. The ice bath was removed and the reaction was allowed to come to room temperature. Polymer molecular weight was maximized by addition with stirring of bisphenol-A bischloroformate (0.35 g, 0,001 mol) dissolved in 3 ml of dichloromethane (3 ml). After 4 hours the solution was washed with 2% hydrochloric acid (2×200 ml) and water (3×300 ml) followed by a methanol precipitation to yield a white polymer. This was then isolated and dried in a vacuum oven overnight at 50° C. The polymer had a molecular weight of approx. 300,000 and a Tg of 70° C.

Preparation 2 (Polymer E-32)

A polyurethane of isophorone diisocyanate, diethylene glycol(99 mole %), and a bis (aminopropyl-terminated) polydimethylsiloxane (1 mole %).

To a 3 neck round bottom flask equipped with a stirrer, dropping funnel and condenser were added diethyleneglycol (10.5 g, 0,099 mol), 14,000 molecular weight aminopropyl-terminated polydimethylsiloxane (1.7 g, 0,001 mol), tetrahydrofuran (150 g) and dibutyltin dilaurate (5 drops). The flask was placed in a constant temperature bath at 40° C. and while stirring isophorone diisoycanate (22.2 g, 0.10 mol) was added. The dropping funnel was then removed and the mixture was swept under nitrogen. The temperature was increased to 70° C. and the reaction was stirred overnight. At that time when no free isocyanate was found to be present, the solution was cooled, poured into water and the polymer was isolated. The polymer was then placed in a vacuum oven at 70° C. for 3 days to remove all the tetrahydrofuran. The polymer had a molecular weight of approx. 27,500 and a Tg of 81° C.

Preparation 3 (Polymer E-41)

A polyester of azelaic acid, bisphenol-A (99 mole %) and a bis (aminopropyl-terminated) polydimethyl siloxane (1 mole %).

To a 3 neck round bottom flask equipped with a stirrer, dropping funnel and condenser were added bisphenol-A, (22.6 g, 0.099 mol), 3,900 molecular weight aminopropyl terminated polydimethyl siloxane (3.9 g, 0.001 mol), dichloromethane (150 ml) and triethylamine (22.3 g, 0.22 mol). This solution was cooled to 0°-5° C. and with vigorous stirring azelaoyl chloride (22.51 g, 0.10 mol) was added. The solution was then allowed to come to room temperature. Polymer molecular weight was maximized by addition with stirring of portions of azelaoyl chloride (0.23 g, 0.001 mol) dissolved in dichloromethane (3 ml). After 4 hours the mixture was washed with 2% hydrochloric acid (2×200 ml) and water (3×300 ml) followed by precipitation with methanol to yield a white polymer. The polymer was then isolated and dried at 20° C. overnight. The polymer had a molecular weight of approx. 300,000 with a Tg of 35° C.

EXAMPLE 1

Use of Polymers of the Invention in Receiver Overcoats

Dye-receiving elements were prepared by coating the following layers in order on white-reflective supports of titanium dioxide pigmented polyethylene overcoated paper stock:

(1) subbing layer of poly(acrylonitrile-co-vinylidene chloride-co-acrylic acid) (14:79:7 wt. ratio) (0.08 g/m$^2$) coated from butanone.

(2) dye-receiving layer of diphenyl phthalate (0.32 g/m$^2$), di-n-butyl phthalate (0.32 g/m$^2$), and Fluorad FC-431® (a surfactant of 3M Corp.) (0.01 g/m$^2$), in a mixture of Makrolon 5700® (a bisphenol-A polycarbonate) (Bayer AG) (1.6 g/m$^2$) and a linear condensation polymer derived from carbonic acid, bisphenol-A, and diethylene glycol (bisphenol:glycol mol ratio 50:50, molecular weight approx. 200,000) (1.6 g/m$^2$) coated from dichloromethane.

(3) overcoat layer of the indicated linear condensation siloxane block copolymer of the invention (0.22 g/m$^2$) coated from dichloromethane. Each overcoat layer also contained Fluorad FC-431® (a surfactant of 3M Corp.) (0.02 g/m$^2$) and Dow Corning 510® Silicone Fluid (0.02 g/m$^2$).

On the reverse side of each dye-receiving element a backing layer (not critical to the invention) was coated as described in Example 1 of U.S. Ser. No. 07/547580 of Martin.

The following polymers were coated in place of the linear condensation siloxane block copolymers of the invention as control overcoat layers over the same subbing layer and main dye-receiving layer:

C-1: No overcoat layer (control)

C-2: Like polycarbonates E-1 to E-9 (1:1 mole ratio of bisphenol to glycol) but z=0 (no amino-terminated polydimethylsiloxane or z component)

C-3: Like polycarbonates E-18 and E-19 but z=0 (no amino-terminated polydimethylsiloxane or Z component)

C-4: Like polyurethane E-31 but z=0 (no amino-terminated polydimethylsiloxane or Z component)

C-5: Like polyurethane E-32 but z=0 (no amino-terminated polydimethylsiloxane or Z component)

C-6: Like polyester E-41 but z=0 (no amino-terminated polydimethylsiloxane or Z component)

Neutral (black) dye-donor elements were prepared by coating the following layers in order on a 6 μm poly(ethylene terephathalate) support:

(1) subbing layer of Tyzor TBT® (a titanium isobutoxide) (duPont Co.) (0.12 g/m$^2$) coated from a n-propyl acetate and 1-butanol solvent mixture.

(2) dye layer of the following yellow dye (0.16 g/m$^2$), major magenta dye (0.24 g/m$^2$) minor magenta dye (0.04 g/m$^2$), cyan dye (0.54 g/m$^2$), and S-363N1 (micronized blend of polyethylene, polypropylene and oxidized polyethylene particles) (Shamrock Technologies, Inc.) (0.023 g/m$^2$) in a cellulose acetate propionate binder (2.5% acetate, 46% propionyl) (0.54 g/m$^2$) from a toluene, methanol, and cyclopentanone solvent mixture.

On the reverse side of the support was coated a subbing layer as described above on top of which was coated a backing (slipping) layer of PS-513 (an aminopropyl-terminated polydimethylsiloxane) (Petrarch Systems, Inc.) (0.011 g/m$^2$), Montan wax (F. B. Ross Co.) (0.032 g/m$^2$), p-toluene sulfonic acid (0.003 g/m$^2$), in a cellulose acetate propionate binder (2.5% acetyl, 46% propionyl) (0.53 g/m$^2$) coated from a toluene, methanol, and cyclopentanone solvent mixture.

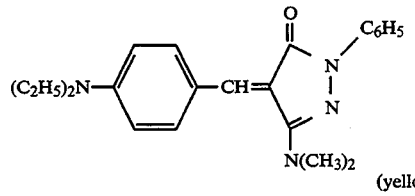

(yellow)

-continued

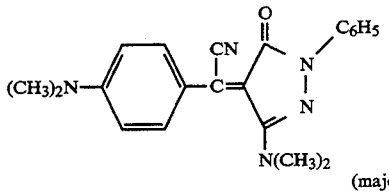

(major magenta)

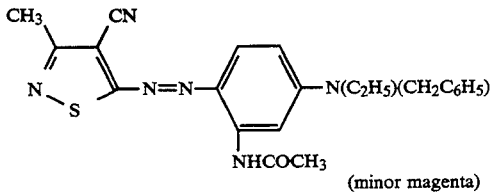

(minor magenta)

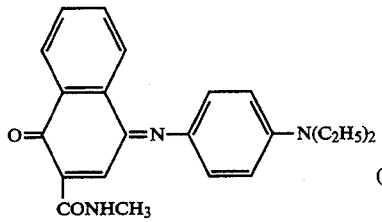

(cyan)

The dye side of the dye-donor element approximately 10 cm×15 cm in area was placed in contact with the polymeric receiving layer side of the dye-receiver element of the same area. The assemblage was fastened to the top of a motor-driven 60 mm diameter rubber roller and a TDK Thermal Head L-232 (300 DPI), thermostatted at 26° C., was pressed with a spring at a force of 36 Newtons against the dye-donor element side of the assemblage pushing it against the rubber roller.

The imaging electronics were activated and the assemblage was drawn between the printing head and roller at 31 mm/sec. Coincidentally, the resistive elements in the thermal print head were pulsed at 156 μsec intervals (127 μsec/pulse) during the 5 msec/dot printing time. The voltage supplied to the print head was approximately 20 v resulting in an instantaneous peak power of approximately 0.27 watts/dot and a maximum total energy of 8.1 mjoules/dot. A stepped density image was generated by incrementally increasing the pulses/dot through a defined range to a maximum of 32.

After one stepped density image was generated, the printing cycle was repeated a second time with a new area of dye-donor onto the same area of dye-receiver. Dye-donor sticking was characterized as:

None-No sticking observed, donor element separated cleanly from receiver.

Slight-Partial sticking in one step (usually one of higher density).

Moderate-Partial sticking in two steps.

Severe-Partial sticking in three or more steps.

| Overcoat | Sticking Observed |
|---|---|
| C-1 (none) (control) | Moderate |
| C-2 (polycarbonate) | Moderate |
| E-1 (siloxane block polycarbonate) | Slight |
| E-2 (siloxane block polycarbonate) | None |
| E-3 (siloxane block polycarbonate) | Slight |
| E-4 (siloxane block polycarbonate) | None |
| E-5 (siloxane block polycarbonate) | None |
| C-3 (polycarbonate) | Moderate |
| E-18 (siloxane block polycarbonate) | None |

-continued

| Overcoat | Sticking Observed |
|---|---|
| E-19 (siloxane block polycarbonate) | None |
| C-4 (polyurethane) | Severe |
| E-31 (siloxane block polyurethane) | Moderate |
| C-5 (polyurethane) | Severe |
| E-32 (siloxane block polyurethane) | None |
| C-6 (polyester) | Slight |
| E-41 (siloxane block polyester) | None |

The data above show that receiver overcoats of polymers of the invention containing a block polysiloxane unit linearly condensed into polycarbonates, polyurethanes and polyesters provide lessened donor to receiver sticking compared to otherwise equivalent overcoats of polycarbonates, polyurethanes, and polyesters without the siloxane block unit. The transferred dye-density for the invention and control receivers in each case was greater than 2.0.

EXAMPLE 2

Use of Polymers of the Invention in Receiver Overcoats

This example is similar to Example 1, providing additional data for dye-donor to receiver sticking with receiver overcoats of polymers of the invention containing polysiloxane block units, and illustrates comparable results are not obtained merely with mixtures of polydimethylsiloxanes and a polycarbonate in a receiver overcoat.

Dye-receiving elements were prepared by coating the following layers in order on a white-reflective support of titanium dioxide pigmented polyethylene overcoated paper stock:

(1) subbing layer of poly(acrylonitrile-co-vinylidene chloride-co-acrylic acid) (14:79:7 wt. ratio) (0.08 g/m$^2$) coated from butanone solvent.

(2) dye-receiving layer of diphenyl phthalate (0.32 g/m$^2$), and di-n-butyl phthalate (0.32 g/m$^2$), in a linear condensation polymer derived from carbonic acid, bisphenol-A, and diethylene glycol (bisphenol:glycol mol ratio 50:50, molecular weight approx. 200,000) (5.4 g/m$^2$) coated from dichloromethane.

(3) overcoat layer of the indicated poly(dimethyl siloxane) block copolymer of the invention (0.22 g/m$^2$) plus indicated quantity of amino-terminated polydimethyl siloxane coated from dichloromethane. Each overcoat layer also contained Fluorad FC-431® (a surfactant of 3M Corp.) (0.02 g/m$^2$) and Dow Corning 510® Silicone Fluid (0.02 g/m$^2$).

No layer was coated on the reverse side.

The following quantities of an amino-terminated polydimethylsiloxane (illustrated below) were coated mixed with the polycarbonate (illustrated below) over the dye-receiver layer as comparison overcoats.

| Coating | Polysiloxane |
|---|---|
| C-2 (control) | 0 g/m$^2$ (polycarbonate only) |
| C-7 (comparison) | 0.0011 g/m$^2$ (0.5 wt % of polymer) |
| C-8 (comparison) | 0.0055 g/m$^2$ (2.5 wt % of polymer) |
| C-9 (comparison) | 0.0011 g/m$^2$ (5.0 wt % of polymer) |
| C-10 (comparison) | 0.055 g/m$^2$ (25.0 wt % of polymer) |

The polycarbonate and polydimethylsiloxane are of the following structures:

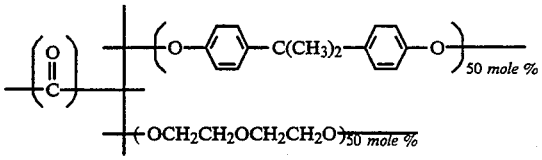

$H_2N(CH_2)_3(Si(CH_3)_2O)_{n350}Si(CH_3)_2(CH_2)_3NH_2$
PS-513 (Petrarch Systems, Inc.)

Neutral (black) dye-donor elements were prepared as described in Example 1.

The same evaluation procedure was used as in Example 1 except the printing cycle was repeated three times onto the same area of dye-receiver rather than just twice. The same criteria for sticking were used as in Example 1.

| Overcoat | Sticking Observed |
|---|---|
| C-2 (polycarbonate) | Moderate |
| C-7 (polycarbonate + siloxane mix) | Moderate |
| C-8 (polycarbonate + siloxane mix) | Moderate |
| C-9 (polycarbonate + siloxane mix) | Moderate |
| C-10 (polycarbonate + siloxane mix) | Slight |
| E-2 (siloxane block polycarbonate) | None |
| E-5 (siloxane block polycarbonate) | None |
| E-6 (siloxane block polycarbonate) | None |
| E-7 (siloxane block polycarbonate) | None |
| E-9 (siloxane block polycarbonate) | None |

The data above show that mixtures of polydimethylsiloxanes with linear polycarbonates do not provide as satisfactory performance with regard to dye-donor to receiver sticking as do the linear polymers of the invention containing a block polysiloxane unit. The transferred dye-density for the invention and control receivers in each case was greater than 2.0.

Example 3

Use of Polymers of the Invention in Receiving Layers

This example is similar to Example 1 but provides data for dye-donor to receiver sticking when a polycarbonate containing a polysiloxane block unit is used as a receiving layer itself rather than as an overcoat on another polymeric receiving layer.

Dye-receiving elements were prepared by coating the following layers in order on a white-reflective support of titanium dioxide pigmented polyethylene overcoated paper stock:

(1) Subbing layer of poly(acrylonitrile-co-vinylidene chloride-co-acrylic acid) (14:79:7 wt. ratio) (0.08 g/m$^2$) coated from butanone solvent.

(2) Dye-receiving layer of the polycarbonate block copolymerized with a polydimethyl siloxane (E-5 described above) (5.4 g/m$^2$) coated from dichloromethane. Each layer also contained Dow Corning 510® Silicone Fluid (0.03 g/m$^2$) and Fluorad FC-431® (a surfactant of 3M Corp.) (0.016 g/m$^2$). Before use each coating was dried at room temperature for six days.

A control coating was prepared as described above, except the dye-receiving layer polymer was a linear condensation polymer derived from carbonic acid, bisphenol-A, and diethylene glycol (bisphenol:glycol mol ratio 50:50, molecular weight approx. 200,000) (5.4 g/m$^2$) coated from dichloromethane.

Neutral (black) dye-donor elements were prepared as described in Example 1.

The same evaluation procedure was used as in Example 1 except only one printing cycle was used. The same criteria for sticking were used as in Example 1. The following results were obtained:

| Receiver | Sticking Observed |
|---|---|
| E-5 Siloxane block containing polycarbonate | None |
| C-2 Polycarbonate | Moderate |

The data above show that the polymers of the invention containing a block polysiloxane unit give no sticking when used alone as a dye-receiving layer compared to a polycarbonate receiving layer without the polysiloxane block unit. Dye transfer densities (considering the one-cycle printing) were equivalent to the polycarbonate control and to the overcoat containing receivers of Example 1.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a dye image-receiving layer, the improvement wherein the dye image-receiving layer or an overcoat layer thereon comprises a linear condensation copolymer containing block polysiloxane units copolymerized into a linear polymer chain, said linear copolymer comprising from about 1 to about 40 wt % of polysiloxane units.

2. The element of claim 1, wherein the block polysiloxane units of the linear condensation copolymer are derived from functional group terminated polysiloxanes of the following formula (I):

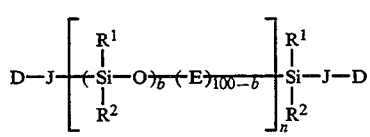

(I)

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit.

3. The element of claim 2, wherein an overcoat layer on the dye image-receiving layer comprises said linear condensation copolymer.

4. The element of claim 2, wherein said linear condensation copolymer is of the following formula (II):

(II)

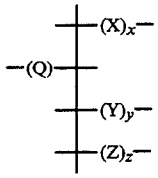

wherein:

Q represents linkage units which together with units X, Y and z form ester type linkage units or amide type linkage units;

X is derived from one or more non-phenolic diol units, present at x=0 to 99.9 mole %;

Y is derived from an aromatic diphenolic unit, present at y=0 to 99.9 mole %;

Z is derived from the polysiloxane of formula (I) present at z=0.1 to 10.0 mole %; and $x+y+z=100.$

5. The element of claim 4, wherein an overcoat layer on the dye image-receiving layer comprises said linear condensation copolymer.

6. The element of claim 4, wherein the linear condensation copolymer is a polycarbonate.

7. The element of claim 6, wherein X and Y are present at a molar ratio of from 1:3 to 3:1.

8. The element of claim 4, wherein the linear condensation copolymer is a polyurethane and Q is derived from a diisocyanate.

9. The element of claim 8, wherein x is from 90 to 99.9 mole %.

10. The element of claim 4, wherein the linear condensation copolymer is a polyester and Q is derived from an aromatic or aliphatic dibasic acid.

11. The element of claim 10, wherein Q is derived from a dibasic aliphatic acid and y is from 75 to 99.9 mole %.

12. The element of claim 10, wherein Q is derived from a dibasic aromatic acid and x is from 75 to 99.9 mole %.

13. The element of claim 1, wherein the linear condensation copolymer comprises from about 3 to about 30 wt. % of the polysiloxane block units.

14. The element of claim 1, wherein the dye image-receiving layer comprises said linear condensation copolymer.

15. The element of claim 1, wherein an overcoat layer on the dye image-receiving layer comprises said linear condensation copolymer.

16. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, the improvement wherein the dye image-receiving layer or an overcoat layer thereon comprises a linear condensation copolymer containing block polysiloxane units copolymerized into a linear polymer chain, said linear copolymer comprising from about 1 to about 40 wt % of polysiloxane units.

17. The process of claim 16, wherein the block polysiloxane units of the linear condensation copolymer are derived from functional group terminated polysiloxanes of the following formula (I):

(I)

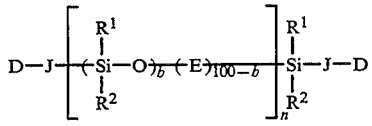

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit;

and further wherein said linear condensation copolymer is of the following formula (II):

(II)

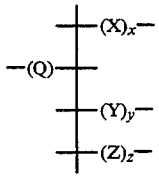

wherein:

Q represents linkage units which together with units X, Y and Z form ester type linkage units or amide type linkage units;

X is derived from one or more non-phenolic diol units, present at x=0 to 99.9 mole %;

Y is derived from an aromatic diphenolic unit, present at y=0 to 99.9 mole %;

Z is derived from the polysiloxane of formula (I) present at z=0.1 to 10.0 mole %; and $x+y+z=100.$

18. In a thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer or an overcoat layer thereon; the improvement wherein the dye image-receiving layer or the overcoat layer thereon comprises a linear condensation copolymer containing block polysiloxane units copolymerized into a linear polymer chain., said linear copolymer comprising from about 1 to about 40 wt % of polysiloxane units.

19. The assemblage of claim 18, wherein the block polysiloxane units of the linear condensation copolymer are derived from functional group terminated polysiloxanes of the following formula (I):

(I)

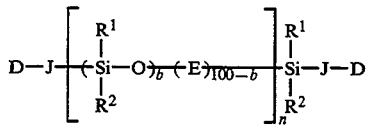

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit;

and further wherein said linear condensation copolymer is of the following formula (II):

(II)

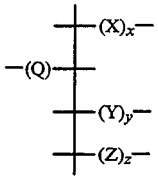

wherein:

Q represents linkage units which together with units X, Y and Z form ester type linkage units or amide type linkage units;

X is derived from one or more non-phenolic diol units, present at x=0 to 99.9 mole %;

Y is derived from an aromatic diphenolic unit, present at y=0 to 99.9 mole %;

Z is derived from the polysiloxane of formula (I) present at z=0.1 to 10.0 mole %; and $x+y+z=100.$

* * * * *